United States Patent [19]

Küpper et al.

[11] Patent Number: 4,634,065

[45] Date of Patent: Jan. 6, 1987

[54] DEVICE FOR INSERTING THE THREAD END OF A TEXTILE BOBBIN INTO A BOBBIN SLEEVE

[76] Inventors: Wilhelm Küpper, Am Betelsberg 10, 5144 Wegberg; Helmuth Hensen, Stadtwaldstrasse 79, 4050 Moenchengladbach, both of Fed. Rep. of Germany

[21] Appl. No.: 805,329

[22] Filed: Dec. 4, 1985

[30] Foreign Application Priority Data

Dec. 8, 1984 [DE] Fed. Rep. of Germany ..... 3444821

[51] Int. Cl.[4] ..... B65H 54/00

[52] U.S. Cl. ..... 242/18 R; 242/35.6 R; 242/35.6 E

[58] Field of Search ..... 242/18 R, 18 EW, 35.5 R, 242/35.5 R, 35.6 R, 35.6 E

[56] References Cited

U.S. PATENT DOCUMENTS

| | | | |
|---|---|---|---|
| 3,279,712 | 10/1966 | Furst | 242/35.5 R |
| 3,295,775 | 1/1967 | Raasch et al. | 242/35.5 R |
| 3,544,018 | 12/1970 | Stoppard et al. | 242/35.6 R |
| 3,708,134 | 1/1973 | Stoppard | 242/18 R |
| 3,727,852 | 4/1973 | Nelson et al. | 242/35.6 R |
| 3,850,377 | 11/1974 | Pitts et al. | 242/35.6 R |
| 4,576,340 | 3/1986 | Aretz et al. | 242/35.6 E X |

*Primary Examiner*—Stanley N. Gilreath

[57] ABSTRACT

A device for inserting the thread end of a textile bobbin into a bobbin sleeve includes a bobbin conveyer, slip-on arbors disposed on the bobbin conveyer, each of the slip-on arbors being a tube with upper and lower open ends for receiving a bobbin sleeve thereon, a first controllable suction nozzle, a device for positioning the first suction nozzle against the lower end of one of the slip-on arbors on which a bobbin sleeve is disposed, a controllable mechanical thread stripper for stripping thread from the bobbin sleeve, a thread clamp, a second controllable suction nozzle connected to the thread stripper and to the thread clamp, a device for moving the second suction nozzle upward and downward into a stop position against the upper end of the bobbin sleeve, a controllable holding device for laterally pressing the base of the bobbin sleeve against the one slip-on arbor, a thread severing device disposed downstream of the second suction nozzle as seen in travel direction of a thread end separated from the bobbin above the bobbin sleeve, and a device for reversing the direction of suction air flow acting on the thread end separated from the bobbin for inserting the thread end into the bobbin sleeve.

9 Claims, 13 Drawing Figures

DEVICE FOR INSERTING THE THREAD END OF A TEXTILE BOBBIN INTO A BOBBIN SLEEVE

The invention relates to a device for inserting the thread end of a textile bobbin standing on a slip-on arbor of a bobbin conveyer into the sleeve of the bobbin, including a first controllable suction nozzle or aperture which can be positioned against the bobbin sleeve and another controllable suction aperture which can be moved up and down and can be positioned against the textile bobbin.

It is difficult to locate the thread end of a texile bobbin, particularly the thread end of a spinning cop, and to pull it off the tip of the sleeve, in order to be able to subsequently insert it into the bobbin sleeve, as a step taken in preparation for a rewinding operation, while always maintaining the same thread length from one operation to the next.

It is accordingly an object of the invention to provide a device for inserting the thread end of a textile bobbin into a bobbin sleeve, which overcomes the hereinaforementioned disadvantages of the heretofore-known devices of this general type, and to automatically grip the thread end, to pull it off, to shorten it and to insert a piece of the thread end which always has the same length into the bobbin sleeve, without this process taking a great deal of time and being trouble prone.

With the foregoing and other objects in view, there is provided a device for inserting the thread end of a textile bobbin into a bobbin sleeve, comprising a bobbin conveyer, slip-on arbors disposed on the bobbin conveyer, each of the slip-on arbors being a tube with upper and lower open ends for receiving a bobbin sleeve thereon, a first controllable suction nozzle or aperture, means for positioning the first suction nozzle against the lower end of one of the slip-on arbors on which a bobbin sleeve is disposed or against the bobbin sleeve, a controllable mechanical thread stripper for stripping thread from the bobbin sleeve, a thread clamp, a second controllable suction nozzle or aperture connected to the thread stripper and to the thread clamp, means for moving the second suction nozzle or the thread stripper or clamp upward and downward into a stop position against the upper end of the bobbin sleeve or bobbin, a controllable holding device for laterally pressing the base of the bobbin sleeve against the one slip-on arbor, a thread severing device disposed downstream of the second suction nozzle as seen in travel direction of a thread end separated from the bobbin above the bobbin sleeve, and means for reversing the direction of suction air flow acting on the thread end dislodged or separated from the bobbin for inserting the thread end into the bobbin sleeve.

In particular, the mechanical thread stripper is capable of stripping turns of thread off the tip of the sleeve. The controllable thread clamp is capable of mechanically clamping the stripped-off thread. The upper suction nozzle or aperture picks up the thread end and due to the fact that the nozzle or parts connected thereto can be positioned at a stop against the upper end of the bobbin sleeve, the nozzle or the parts connected thereto act as a thread clamp or thread brake at the instant when the controllable mechanical thread clamp is opened and the thread end is sucked into the second or upper suction nozzle or aperture. The thread severing device can then become operative and shorten the thread end to a predetermined length. Simultaneously or subsequently, a suction air flow becomes operative in the reverse direction, so that the thread end which is at its final length, is sucked into the bobbin sleeve. During the process, the thread end is guided in a tubular channel extending between the thread severing device and the upper suction nozzle or aperture. Therefore, the thread end cannot escape and is transported into the bobbin sleeve. As soon as this suction air flow also ceases, the device can assume its starting position and release the textile bobbin for further transport.

The bobbin conveyer advantageously operates in synchronism, so that the entire device need not travel along.

In accordance with another feature of the invention, the thread stripper includes two stripping jaws laterally movable against the upper end of the bobbin sleeve. The jaws rest against the upper end of the bobbin sleeve and as soon as the upper suction nozzle moves up, the thread stripper also moves up through the same distance and in the process takes along the turns wound around the bobbin sleeve.

In accordance with a further feature of the invention, the thread clamp includes two spring-loaded clamping jaws each being pivotably supported on a respective one of the stripping jaws. If the jaws of the thread stripper open, then the clamping jaws of the thread clamp also open, but with a small delay because the release travel distance of the springs must be taken into consideration. Upon further opening of the thread stripper, the thread clamp also opens wider and wider until it can finally extend over the upper part of the textile bobbin. If the thread stripper then closes, the clamping jaws of the thread clamp also close, but they initially rest resiliently against the upper end of the textile bobbin. If the thread stripper then travels upward, the clamping jaws of the thread clamp travel along resiliently until they finally slip off the tip of the bobbin sleeve and grip and hold the thread end in the process. Due to further upward motion, a piece of thread of desired length can also be pulled off the textile bobbin.

In accordance with an added feature of the invention, there is provided a suction channel disposed upstream of the thread severing device as seen in travel direction of the thread end above the bobbin sleeve, the thread severing device being controllable thread scissors disposed between the second suction nozzle and the suction channel and being movable into a closed position shutting off the suction channel. As soon as the thread scissors have cut through the thread end, the upward suction flow simultaneously ceases so that the suction flow starting from the lower suction aperture can become dominant. The downward suction flow can alternatively be caused by merely opening a valve. In any case, a thread end of a predetermined length travels into the interior of the bobbin sleeve due to a reversal of the suction air flow. As soon as the downward suction air flow is shut off again after a short activation time and the second suction nozzle has occupied its starting position, the textile bobbin which is now prepared for rewinding can be transported away.

In accordance with an additional feature of the invention, there is provided a sleeve surrounding the second suction nozzle, the thread stripper and the thread clamp having a width being greater than the width of a textile bobbin, and means for moving the sleeve upward and for moving the sleeve downward at least partially over the textile bobbin. The purpose of such a sleeve is primarily to make the suction air flow effective only in the vicinity of the textile bobbin.

In accordance with again another feature of the invention, the sleeve has a bottom having a circular opening formed therein, the opening having a diameter larger than the outside diameter of the bobbin. Such a bottom and such an opening advantageously also serve for centering the textile bobbin and therefore improve the operating reliability of the device.

In accordance with again a further feature of the invention, there is provided a compressed air blasting device disposed at the lower part of the sleeve and aimed toward the bobbin. This is done so that thread turns can be separated from the surface of the textile bobbin easily and quickly. A compressed air jet which may be aimed upward at an angle or several such compressed air jets can loosen end turns of the thread and transport them into the range of the thread clamp, such as during the upward motions of the sleeve.

Even from the explanations given so far, it becomes clear that the distance between the first suction nozzle and the thread severing device is responsible for the final length of the thread end. If a particularly long thread end is desired, this distance must be accordingly large and the device must have a corresponding height. In order to avoid this and to be able to vary the length of the thread end from case to case in a simple manner, in accordance with again an added feature of the invention, there is provided a controllable loop pulling device connected to the second suction nozzle.

In accordance with a concomitant feature of the invention, the thread loop pulling device includes two dogs or carriers and means for swinging the carriers in opposite directions between the bobbin and the thread clamp. The thread end which is present after the thread scissors are operated becomes longer or shorter depending on how far the dogs or carriers swing out.

Other features which are considered as characteristic for the invention are set forth in the appended claims.

Although the invention is illustrated and described herein as embodied in a device for inserting the thread end of a textile bobbin into a bobbin sleeve, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
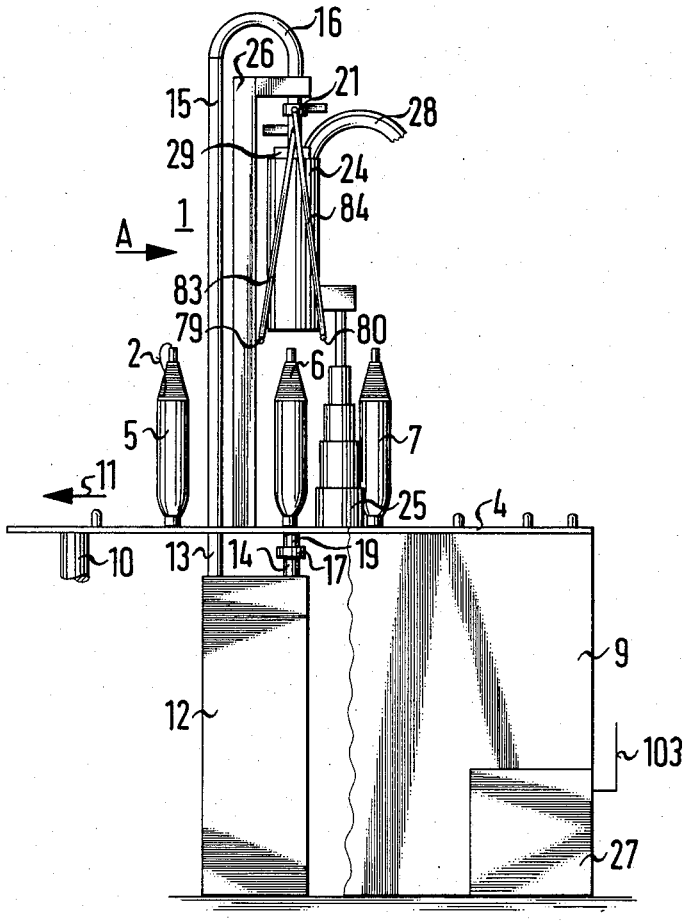
FIG. 1 is a fragmentary, diagrammatic, side-elevational view of the insertion device according to the invention.
Figure 2:
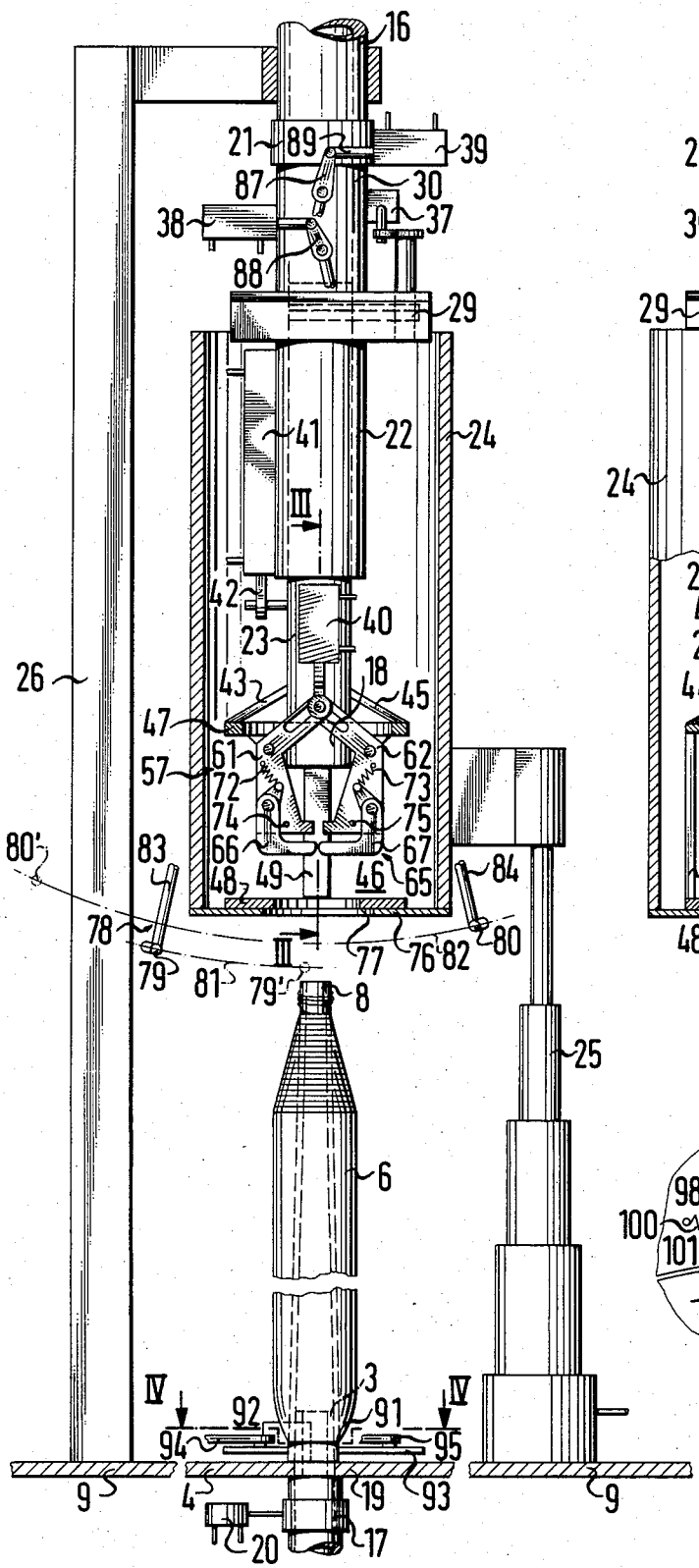
FIG. 2 is a fragmentary, partially cross-sectional side view of the device shown in FIG. 1 on a larger scale, with the sleeve cut open.

Referring now to the figures of the drawings in detail and first, particularly, to FIGS. 1 and 2 thereof, there is seen a device generally designated with reference numeral 1, which serves for inserting the thread end 2 of a textile bobbin 6 standing on a slip-on arbor 3 of a bobbin conveyer 4, into a bobbin sleeve 8.

The bobbin conveyer 4 is formed of a disc which is supported on a table 9, the central shaft 10 of which is rotated by nonillustrated means, through such a large angle of rotation that the bobbin conveyer 4 continues to travel in the direction of the arrow 11 past the center spacing of two adjacent slip-on arbors. According to FIG. 1, the bobbin conveyer 4 carries a previously prepared textile bobbin 5, the above-mentioned textile bobbin 6 which is just being prepared, and a not yet prepared textile bobbin 7.

Disposed behind the enclosure of the table 9, is a suction air source 12 with two outputs 13 and 14. The output 13 is connected to a standpipe 15 which ends in a channel or elbow 16 at the top. The output 14 is connected through a control valve 17 to a suction nozzle or aperture 19. According to FIG. 2, the valve 17 can be controlled by a pneumatic control cylinder 20.

FIG. 2 shows particularly clearly that the slip-on arbors 3 of the bobbin conveyer 4 are constructed as tubes which are open at both ends. The suction nozzle or aperture 19 can be set or aligned against one of the respective tubular slip-on arbors 3 from below, which is accomplished by turning the shaft 10. The setting or alignment of the suction nozzle or aperture 19 against the tubular slip-on arbor 3, is accomplished when the suction aperture and the tube are aligned.

FIGS. 1 and 2 especially show that the channel or elbow 16 is connected through a valve 21, a connecting line 30 and a thread severing device 29 to a telescoping tube 22. A further telescoping tube 23 is supported in the telescoping tube 22 in such a way as to be movable up and down. The telescoping tube 23 ends in a suction nozzle or aperture 18. The suction nozzle or aperture 18 is surrounded by a sleeve 24 which can be moved up and down and the inside diameter of which is so large, that during its downward motion it also extends over the textile bobbin 6, as is shown in particular in FIG. 5. The sleeve 24 is connected to a telescoping tube device 25 which can be actuated pneumatically and can be extended vertically. A support 26 standing on the table 9 is connected to the elbow 16 and thus serves for stabilizing the standpipe 15.

The table 9 also supports a pneumatic control device 27, at which all pneumatic control lines terminate. Thus, for instance, the control line bundle 28 which is shown in FIG. 1 and which lead to pneumatic positioning motors to be explained below, ends at the pneumatic control device 27 which contains all of the required control valves and a program timer.

Figure 6:
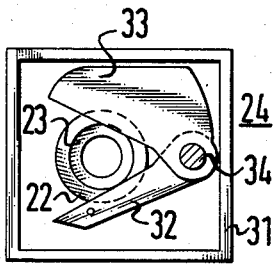
FIG. 6 is a partially cross-sectional view taken along the line VI—VI in FIG. 5, in the direction of the arrows.

According to FIG. 6, the thread severing device 29 is in the form of scissors and has a housing 31 which is connected to the telescoping tube 22. The housing 31 contains a stationary scissor blade 32 and a movable scissor blade 33. The movable scissor blade 33 has the shape of a wing and is fastened to a shaft 34. The shaft protrudes upward through a lid 35 of the housing 31 and ends at a control lever 36. The control lever 36 is connected to a pneumatic control motor 37.

In order to move the telescoping tube 23 and therefore the suction nozzle or aperture 18 vertically, the telescoping tube 22 carries a pneumatic positioning motor 41, the piston rod 42 of which is connected to the telescoping tube 23 in an articulating manner.

Supports 43, 44, 45 connect the suction aperture 18 to a cage 46 which is formed of an upper ring 47, a lower ring 48 and two vertical rods 49 and 50 interconnecting the rings. The ring 45 carries four support eyes 51 to 54 which are shown particularly in FIG. 7. The support eyes 51 and 52 support a vertical shaft 55 and the support eyes 53 and 54 support a vertical shaft 56. The shafts 55 and 56 support a controllable mechanical thread stripper which is generally designated with reference numeral 57. The thread stripper 57 has two notched stripping jaws 58 and 59. The jaw 58 is supported by two angle levers 60, 61 and the jaw 59 is supported by two angle levers 62, 63. The angle levers 60 and 61 are fastened to the shaft 55 and the angle levers 62 and 63 are fastened to the shaft 56. The shorter ends of the two angle levers 61 and 62 are connected in an articulating manner to a piston rod 64 of a pneumatic positioning motor 40 which is fastened to the telescoping tube 23.

Figure 5:
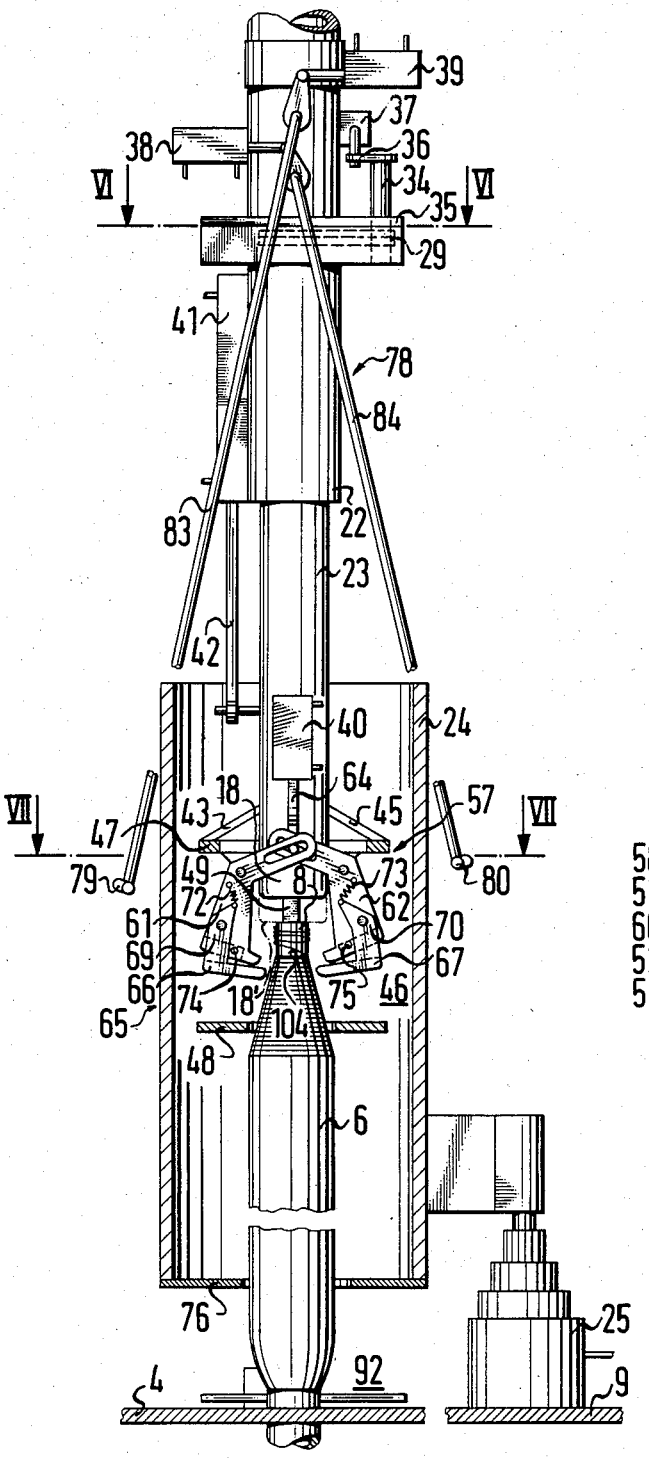
FIG. 5 is a view similar to a portion of the device shown in FIG. 2, but in the lowered condition.

The rest position of the thread stripper 57 is shown in FIG. 2. In the rest position, the two jaws are not closed completely. The open position is shown in FIG. 5. The piston rod 64 is withdrawn downward and has tilted the angle levers, so that the jaws have been removed farther laterally from each other.

The thread stripper 57 supports a controllable mechanical thread clamp, which is generally designated with reference numeral 65. This support is specifically discussed below:

The thread clamp 65 has two spring-loaded clamping jaws 66 and 67. According to FIG. 7, the clamping jaw 66 is suspended from two straps 68 and 69 and the clamping jaw 67 is suspended from two straps 70 and 71. The straps 68 and 69 are tiltably suspended at the angle levers 60 and 61 and the straps 70 and 71 are tiltably suspended at the angle levers 62 and 63. A tension spring 72 draws the strap 69 against a stop 74 and the strap 70 is drawn by a tension spring 73 against a stop 75, if the thread clamp 65 is in the opened position, as is shown in FIG. 5. If, on the other hand, the thread clamp 65 is in the closed position, as shown in FIG. 2, the two tension springs 72 and 73 bring the clamping jaws 66 and 67 into resilient contact with each other.

The sleeve 24 has a bottom 76 which has a circular opening 77 formed therein. The diameter of the opening 77 is somewhat larger than the outside diameter of the textile bobbin 6.

Figure 3:
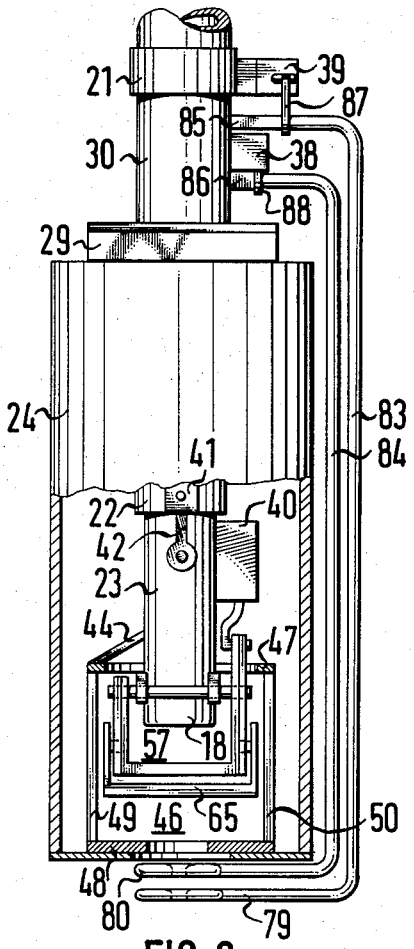
FIG. 3 is a fragmentary, partially cross-sectional view taken along the direction "a" according to FIG. 1, with the sleeve cut open along the line III—III in FIG. 2, in the direction of the arrows.

As is shown particularly in FIG. 5, the suction aperture 18 is connected to a controllable thread loop pulling device generally designated with reference numeral 78, through the telescoping tube 23, the telescoping tube 22, the thread scissors 29 and the connecting line 30. The thread loop pulling device 78 has two dogs or carriers 79, 80 which can be moved in opposite directions and can be swung between the textile bobbin 6 and the thread clamp 65. According to FIG. 2, the dog 79 can swing along a swinging path 81 into a position 79'. The dog 80 can swing along a swinging path 82 into a position 80'. The dog 79 is disposed at the end of a rod 83 and the dog 80 is disposed at the end of a rod 84. According to FIG. 3, the rod 83 is supported in a bearing 85 and the rod 84 is supported in a bearing 86. The two bearings 85 and 86 are fastened to the connecting line 30. The rod 83 is firmly connected to a crank 87 and the rod 84 is firmly connected to a crank 88. The crank 87 is connected to the piston rod 89 of a pneumatic positioning motor 39 and the crank 88 is connected to the piston rod 90 of a pneumatic positioning motor 38.

Figure 4:
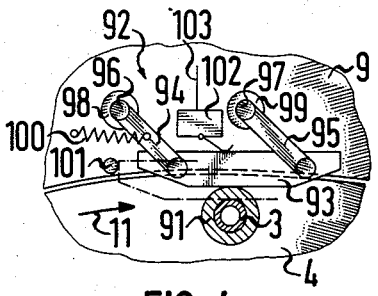
FIG. 4 is a partially cross-sectional view taken along the line IV—IV in FIG. 2, in the direction of the arrows.

According to FIGS. 2 and 4, the device 1 has a controllable holding device generally designated with reference numeral 92, which can be set against the base 91 of the bobbin sleeve 8 from the side and pushes the base 91 against the slip-on arbor 3.

The holding device 92 operates completely automatically. It is formed of a horizontal runner 93 which is disposed at the height of the base 91 and is articulatingly suspended from two straps 94, 95 for parallel guidance. The strap 94 is connected to a shaft 96 and the strap 95 is connected to a shaft 97. The shafts 96, 97 are disposed vertically and are supported in bearings 98, 99 fastened to the table 9. The strap 94 is loaded by a tension spring 100 in such a manner that the runner 93 rests against a stop 101 in a readiness position. Upon rotary motion of the bobbin conveyer 4 in the direction of the arrow 11, the base 91 of the bobbin sleeve 8, which is slipped over the slip-on arbor 3, slides along the runner 93 which thereupon gives way and moves into the operating position shown in FIG. 4, pushing the base 91 against the slip-on arbor 3. The respective position of the runner 93 and therefore the presence of a base 91 and the position of a textile bobbin, can be ascertained by a sensor 102. The sensor 102 is provided in this case in the form of a microswitch having a switching feeler which rests against the runner 93 from the rear, as shown in FIG. 4. An operative connection 103 leads from the sensor 102 to the pneumatic control device 27 shown in FIG. 1.

The device operates as follows:

The program timer contained in the pneumatic control device 27 is switched on by the sensor 102 shown in FIG. 4 as soon as the sensor 102 ascertains that the runner 93 has given way because it came to rest against the base 91 of the bobbin sleeve, in this case against the base of the bobbin sleeve 8 of the textile bobbin 6.

Figure 7:
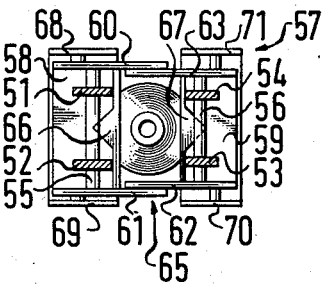
FIG. 7 is a partially cross-sectional view taken along the line VII—VII in FIG. 5, in the direction of the arrows.
Figure 8:
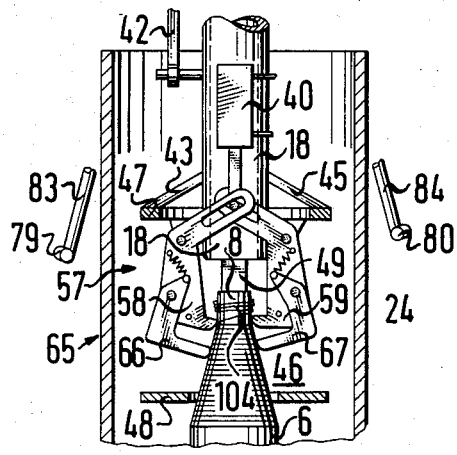

Starting from the rest position shown in FIG. 2, the pneumatic positioning motor 40 is first addressed according to the program and thereupon opens the thread stripper 57 and the thread clamp 65, as is shown in FIGS. 5 and 7. Simultaneously or immediately subsequently, the positioning motor 41 is energized in order to extend the telescoping tube 23, initially as far as is shown in FIG. 5. Subsequently, the pneumatic positioning motor 40 is made to retract its piston rod 64 again, so that the jaws 58 and 59 come to rest against the tip of the bobbin sleeve 8 in order to strip off the reserve turns 104 present there, as is shown in FIG. 8. In the process, the clamping jaws 66 and 67 of the thread clamp 65 come to rest resiliently against the textile bobbin 6 as is likewise shown in FIG. 8. Subsequently, the pneumatic positioning motor 41 is made to retract its piston rod 42 again in order to run the telescoping tube 23 into the starting position again.

Figure 9:
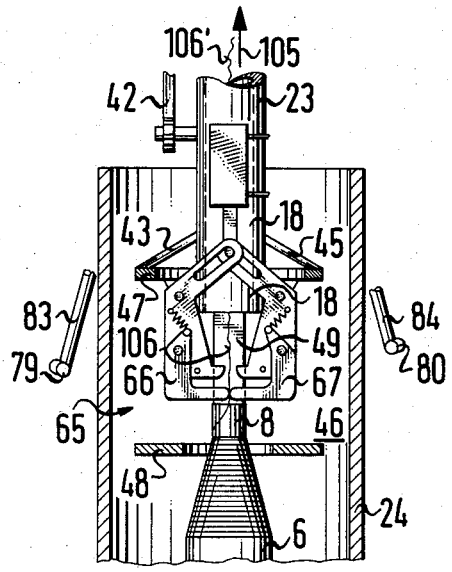
FIGS. 8 and 9 are similar fragmentary, partially cross-sectional views showing details of the device.

As soon as the telescoping tube 23 has reached the position according to FIG. 9 during its upward movement in the direction of the arrow 105, the two clamping jaws 66 and 67 slide off the tip of the bobbin sleeve 8 and in the process clamp the thread end 106. The excess thread length 106' is suctioned off upward because the valve 21 is open. FIG. 9 shows that the thread end disappears in the suction aperture 18.

Independently of the motion cycles described above, the extended telescoping tube device 25 has been caused by the pneumatic control device 27 to return to the retracted position shown in FIG. 5 and to take the sleeve 24 along in the process. During the downward movement of the sleeve 24, air flowed continuously into the suction aperture 18. A large part of this air moves from below through the aperture 77 in the bottom of the sleeve 24 and in the process also flows past the surface of the textile bobbin 6, loosening turns there which may be formed on the surface of the textile bobbin 6 by the thread ends.

Figure 10:
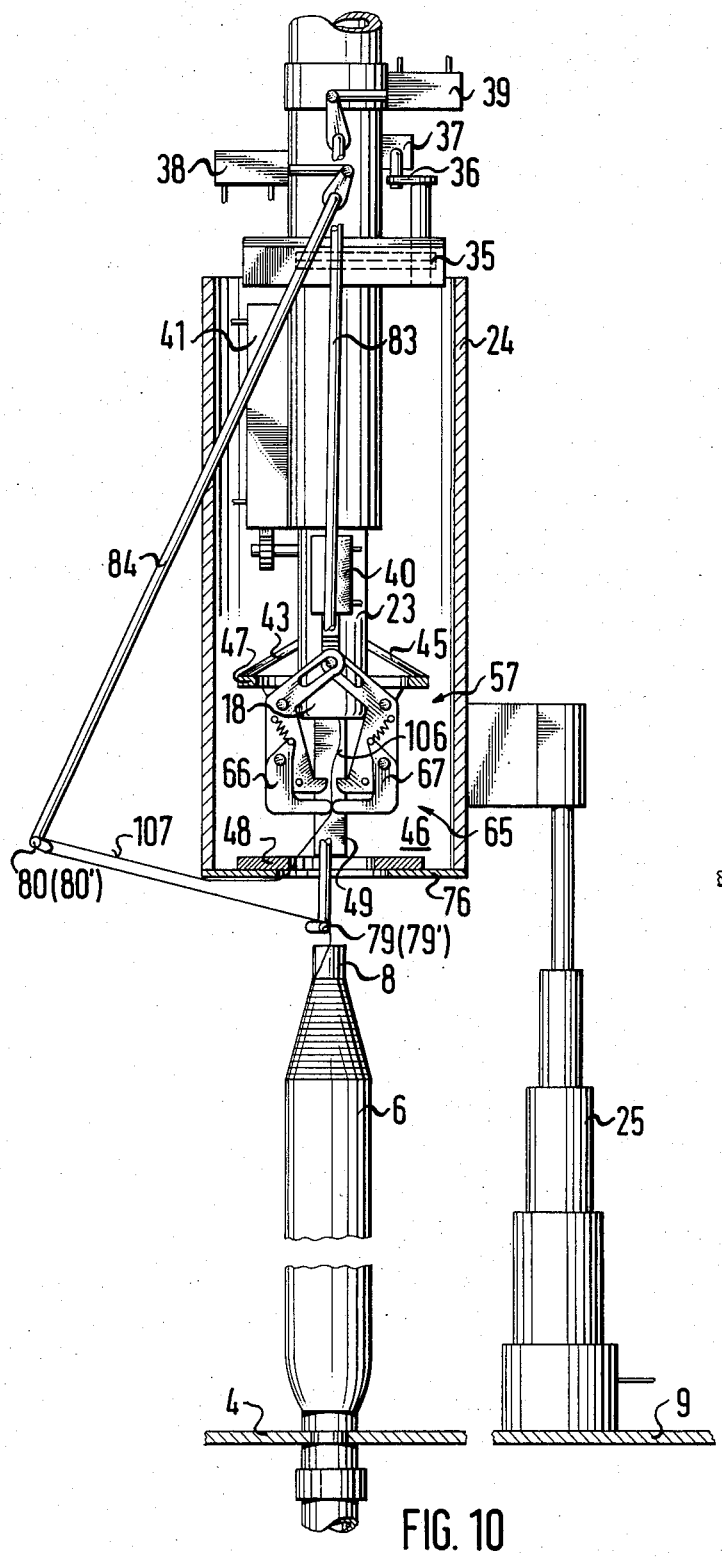
FIG. 10 is another view similar to a portion of FIG. 2, but at the instant that a thread-loop pulling device swings out.

Since the pneumatic positioning motor 41 retracts the piston rod 42, the telescoping tube device 25 is also caused to return to the extended state as is shown in FIG. 10.

The two clamping jaws 66 and 67 of the thread clamp 65 continue to hold the thread end 66.

According to the switching program, two different possibilities are provided for the further operation of the device:

In those cases in which the thread length pulled off in the above-described manner is sufficient to guarantee that only properly wound turns are present on the textile bobbin 6, the telescoping tube device 25 is caused once more to return to the non-extended state and at the same time, the pneumatic positioning motor 40 is also caused to open the thread stripper 57 and the thread clamp 65. In addition, the pneumatic positioning motor 41 is caused to run out the piston rod 42 maximally, so that the suction aperture 18 comes to a stop position 18' on the bobbin sleeve 8, as is indicated in phantom in FIG. 5. The suctioned-in thread end is then clamped between the upper edge of the bobbin sleeve and the suction nozzle or aperture 18. The excess end has been suctioned far into the elbow 16. A further length of thread can then no longer be pulled off the textile bobbin 6.

Subsequently, the thread scissors 29 are actuated by means of the pneumatic positioning motor 37 and the valve 17 is opened for a short time by means of the control cylinder 20. Due to the closing of the thread scissors 29, the suction air flow into the suction aperture 18 ceases and the direction of flow is then reversed because suction air flows directly into the bobbin sleeve 8.

After the thread scissors 29 are actuated, the excess thread end is suctioned off through the standpipe 15 into the suction air source 12. The thread end 106 which is now paid out anew, extends from the tip of the bobbin sleeve 8, where it is still held by the suction aperture 18, to the lid 35 of the thread scissors and is sucked from there imemdiately into the bobbin sleeve 8. Then, the valve 17 is closed.

Figure 11:
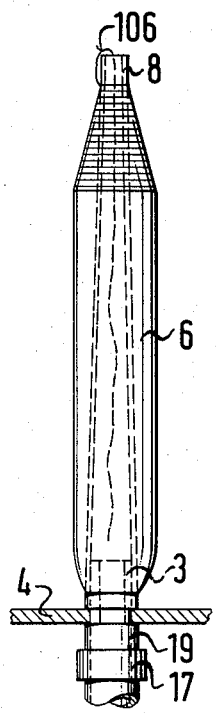
FIG. 11 is a fragmentary view of a completely prepared textile bobbin with a thread end inserted into the bobbin sleeve.

Subsequently, the parts which were previously lowered are returned once more into the starting position shown in FIG. 2. The thread end 106 is then located in the bobbin sleeve 8, as is shown in FIG. 11.

As the last activity, the pneumatic control device 27 causes the transport of the bobbin conveyer 4 to be continued by one division. Thereafter, the individual operations can be repeated.

According to the second possibility mentioned above, the following operation is interposed prior to the second lowering of the telescoping tube 23:

The interposed operation serves the purpose of pulling even more turns off the surface of the textile bobbin 6. For this purpose, the pneumatic control device 27 causes the thread loop pulling device 78 to become active by setting the two pneumatic positioning motors 38 and 39 in operation so that the two rods 83 and 84 are swung successively.

According to FIG. 10, the rod 83 is swung out first in order to bring the dog or carrier 79 into the position 79'. The pneumatic positioning motor 38 then tilts the rod 84 so as to swing the dog or carrier 80 into the position 80', which during the process draws the thread end to form a thread loop 107. The pneumatic positioning motor 40 is then first caused to run out its piston rod again in order to open the thread stripper 57 and the thread clamp 65. Thereafter, the two dogs 79 and 80 of the thread loop pulling device 78 are returned to their starting positions, while the thread end is kept elongated by the suction air flow acting on the thread end, and the pulled-off thread length is suctioned beyond the elbow 16 into the standpipe 15.

The same operation of preparing the thread end, beginning with the lowering of the suction nozzle or aperture 18 down to the bobbin sleeve 8 is followed as in the first possibility described above.

Figure 12:
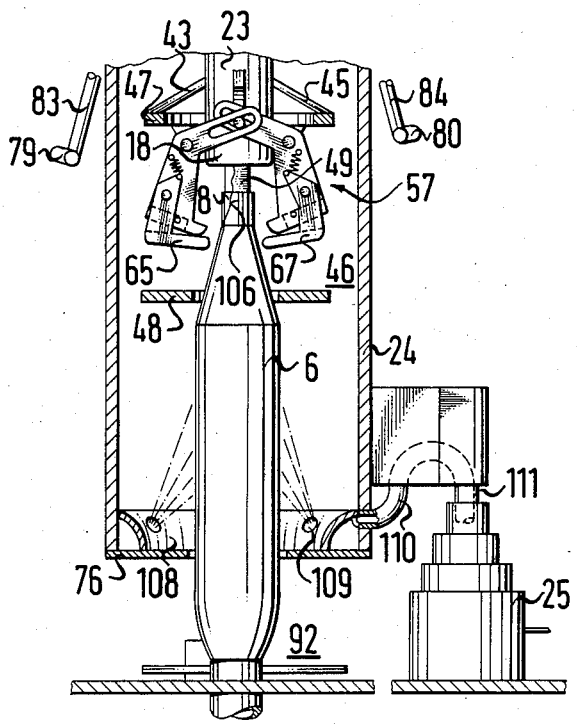
FIG. 12 is another fragmentary, partially cross-sectional view showing details of the device with a built-in compressed-air blasting device, at the beginning of the blasting process.
Figure 13:
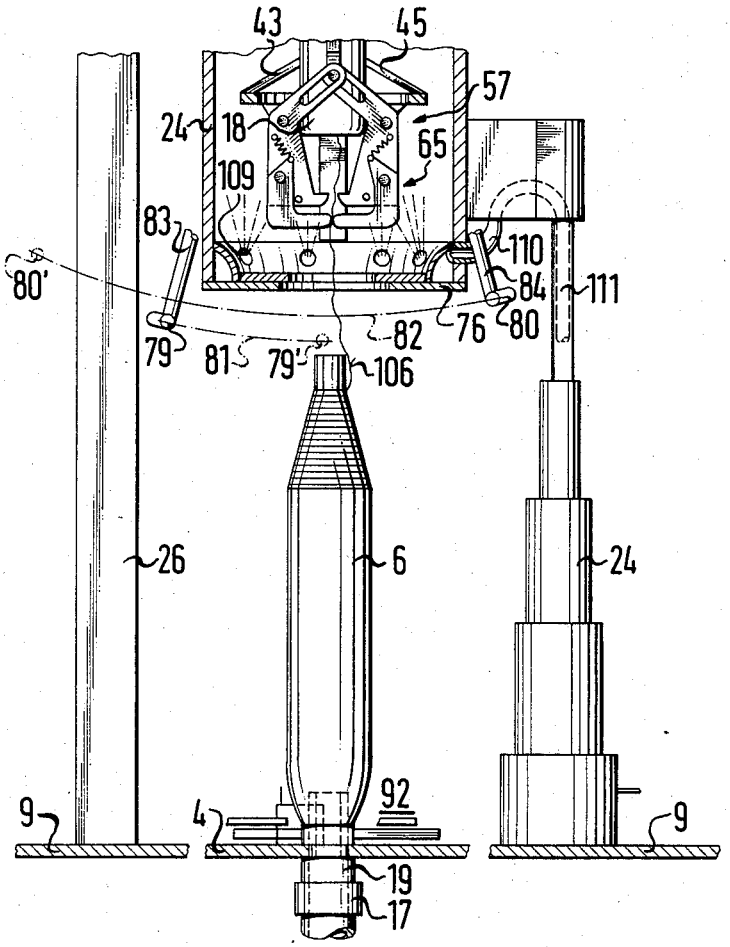
FIG. 13 is a fragmentary, partially cross-sectional view showing details of the device with a built-in compressed-air blasting device, at the end of the blasting process.

The second embodiment of the invention according to FIGS. 12 and 13 does not differ outwardly from the embodiment according to FIGS. 1 to 11, except as follows:

Deviating from the first embodiment, the lower part of the sleeve 24 in FIGS. 12 and 13 is provided with a compressed air blasting device 108 aimed toward the textile bobbin 6. The compressed air blasting device 108 is formed of a ring canal which has blasting openings 109 aimed toward the textile bobbin 6. The compressed air blasting device 108 is connected to an upper telescoping tube 111 of the telescoping tube device 25 by a line 110. Each time the telescoping tube device 25 is acted upon by compressed air in order to run the sleeve 24, for instance, from the position shown in FIG. 12 upward into the position shown in FIG. 13, the compressed air simultaneously flows into the compressed air blasting device 108, so that back turns that may still be present on the textile bobbin 6 are loosened and thus are prepared to be pulled off.

Referring to FIGS. 12 and 13, a further mode of operation will be explained briefly:

After the thread end 106 is pulled off the textile bobbin 6, but prior to cutting the thread end, the suction aperture 18 runs down from the position shown in FIG. 13 only into the position shown in FIG. 12. In this position the suction aperture 18 does not yet touch the tip of the bobbin sleeve 8, but the two clamping jaws 66 and 67 of the thread clamp 65 touch the upper end of the textile bobbin 6 or the bobbin sleeve 8 and thus act as a thread brake against the further pulling-off of the thread end 106. Subsequently, the severing cut is made, whereby a thread end of defined length is produced. Simultaneously with the lowering of the telescoping tube 23, the sleeve 24 is also brought into the lower position shown in FIG. 12.

The invention is not to be limited to the embodiments that are shown and described. In some circumstances, the thread stripper and the thread clamp can form one structural unit. The combination can possibly be taken so far that the same jaws which serve as the thread stripper jaws, also clamp the thread after the stripping.

We claim:

1. Device for inserting the thread end of a textile bobbin into a bobbin sleeve, comprising a bobbin conveyer, slip-on arbors disposed on said bobbin conveyer, each of said slip-on arbors being a tube with upper and lower open ends for receiving a bobbin sleeve thereon, a first controllable suction nozzle, means for positioning said first suction nozzle against said lower end of one of said slip-on arbors on which a bobbin sleeve is disposed, a controllable mechanical thread stripper for stripping thread from the bobbin sleeve, a thread clamp, a second controllable suction nozzle connected to said thread stripper and to said thread clamp, means for moving said second suction nozzle upward and downward into a stop position against the upper end of the bobbin sleeve, a controllable holding device for laterally pressing the base of the bobbin sleeve against said one slip-on arbor, a thread severing device disposed downstream of said second suction nozzle as seen in travel direction of a thread end separated from the bobbin above the bobbin sleeve, and means for reversing the direction of suction air flow acting on the thread end separated from the bobbin for inserting the thread end into the bobbin sleeve.

2. Device according to claim 1, wherein said thread stripper includes two stripping jaws laterally movable against the upper end of the bobbin sleeve.

3. Device according to claim 2, wherein said thread clamp includes two spring-loaded clamping jaws each being pivotably supported on a respective one of said stripping jaws.

4. Device according to claim 1, including a suction channel disposed upstream of said thread severing device as seen in travel direction of the thread end above the bobbin sleeve, said thread severing device being controllable thread scissors disposed between said second suction nozzle and said suction channel and being movable into a closed position shutting off said suction channel.

5. Device according to claim 1, including a sleeve surrounding said second suction nozzle, said thread stripper and said thread clamp having a width being greater than the width of a textile bobbin, and means for moving said sleeve upward and for moving said sleeve downward at least partially over the textile bobbin.

6. Device according to claim 5, wherein said sleeve has a bottom having an opening formed therein, said opening having a diameter larger than the outside diameter of the bobbin.

7. Device according to claim 5, including a compressed air blasting device disposed at the lower part of said sleeve and aimed toward the bobbin.

8. Device according to claim 1, including a controllable thread loop pulling device connected to said second suction nozzle.

9. Device according to claim 8, wherein said thread loop pulling device includes two carriers and means for swinging said carriers in opposite directions between the bobbin and said thread clamp.

* * * * *